US005934668A

United States Patent [19]

Debarber et al.

[11] Patent Number: 5,934,668

[45] Date of Patent: Aug. 10, 1999

[54] DOCUMENT REGISTRATION APPARATUS WITH IMPROVED DOCUMENT DRIVE CAPABILITY

[75] Inventors: Christopher Debarber, Woodbury; Thomas M. Lyga, Torrington; William A. Ross, Darien, all of Conn.

[73] Assignee: Pitney Bowes Inc., Stamford, Conn.

[21] Appl. No.: 08/773,850

[22] Filed: Dec. 27, 1996

[51] Int. Cl.[6] ..... B65H 9/06

[52] U.S. Cl. ..... 271/245; 271/274

[58] Field of Search ..... 271/245, 246, 271/274, 273

[56] References Cited

U.S. PATENT DOCUMENTS

| | | | |
|---|---|---|---|
| 3,072,397 | 1/1963 | Kelchner | 271/245 |
| 4,428,667 | 1/1984 | Phelps et al. | 271/245 |
| 4,470,591 | 9/1984 | Acquaviva | 271/245 |
| 4,750,853 | 6/1988 | Van Soest et al. | 271/246 |
| 5,080,347 | 1/1992 | Funada | 271/246 |
| 5,230,504 | 7/1993 | Schmaling | 271/246 |
| 5,253,861 | 10/1993 | Schmaling | 271/213 |
| 5,255,906 | 10/1993 | Ballard | 271/246 |
| 5,263,705 | 11/1993 | Schmaling | 271/246 |
| 5,566,933 | 10/1996 | Salancy | 271/245 |
| 5,772,202 | 6/1998 | Singer et al. | 271/245 |

FOREIGN PATENT DOCUMENTS

| | | | |
|---|---|---|---|
| 646181 | 8/1962 | Canada | 271/246 |
| 59057843 | 8/1983 | European Pat. Off. . | |
| 0 514 925 A | 11/1992 | European Pat. Off. . | |
| 61-248829 | 11/1986 | Japan | 271/245 |
| 7-291487 | 11/1995 | Japan . | |

*Primary Examiner*—Janice L. Krizek
*Assistant Examiner*—Thuy V. Tran
*Attorney, Agent, or Firm*—Steven J. Shapiro; Melvin J. Scolnick

[57] ABSTRACT

A document registration apparatus for use with a conveying device for transporting a document along a path from an upstream position to a downstream position through a document registration position, the document registration apparatus including an urge roller positioned adjacent to the path, the urge roller being moveable between a first urge roller position contacting the document and a second urge roller position out of contact with the document; apparatus for biasing the urge roller toward the conveying device; and a registration stop positioned adjacent to the urge roller and the path, the registration stop being moveable between a first registration stop position where the registration stop blocks transport of the document along the path and a second registration stop position away from the path where the registration stop does not block transport of the document along the path; wherein at times when the urge roller is in the first urge roller position and the registration stop is in the first registration stop position the biasing apparatus biases the urge roller against the document by a first force thereby urging the document against the conveying device due to the first force so that the document is moved to, aligned against, and stopped by the registration stop at the document registration position.

5 Claims, 8 Drawing Sheets

DOCUMENT REGISTRATION APPARATUS WITH IMPROVED DOCUMENT DRIVE CAPABILITY

BACKGROUND OF THE INVENTION

The present invention relates to a document registration apparatus for use in a document processing system, and more particularly, to a document registration apparatus having an improved document drive system for use in a document inserting station or a document queuing station.

Various document processing systems require that a particular edge of a processed document is aligned relative to a particular direction in the system. For example, enclosures which are to be inserted into an envelope should be aligned relative to the envelope prior to insertion in order to avoid processing difficulties. Furthermore, some documents which are to be transported away from a particular queuing station, to another adjacent document raceway, should be aligned at the queuing station relative to the raceway, in order to facilitate the processing of the documents.

Devices which register a particular edge of a document to a particular direction are known. For example, U.S. Pat. Nos. 5,255,906 which issued to Ballard, et al. on Oct. 26, 1993 and U.S. Pat. No. 5,263,705 which issued to Schmaling on Nov. 23, 1993, each of which are hereby incorporated by reference, disclose a very effective document registration device which is simple in design, is not difficult to adjust for proper alignment, and provides easy access to jammed documents for removal thereof. The apparatus disclosed in the aforementioned patents have been effectively utilized by the assignee of the instant application in its Mail Center 2000™ Spectrum™ Inserting System to register numerous types of documents for various processing purposes. However, the Applicants of the instant invention have identified certain potential drawbacks (as discussed in more detail below) which may occur in the prior art structure and have invented the structure set forth in the instant application to assuredly prevent such drawbacks from occurring. Referring to FIGS. 1–4, which show the prior art structure of the aforementioned patents, a brief explanation of the prior art structure is set forth below together with a discussion of the potential drawbacks mentioned to above.

Document registration apparatus 10 of the present invention is used in conjunction with a document conveyor system 11 which transports a document 12 along a path 13 from an upstream position to a downstream position in the direction of arrow D. Positioned between the upstream position and the downstream position is a document registration position 16 where a document 12 having a flap 12*a* is stopped in its path and is held or queued until the processing system of which conveyor system 11 is a part is ready to process document 12. At the same time, document registration apparatus 10 aligns document 12 relative to path 13, or, if desired, some other document raceway in the system. Although FIG. 3 shows a single document 12, it is to be understood that the present invention is applicable to situations where document 12 is a stack of documents. Document registration apparatus 10 includes a holder unit 19 and a document registration unit 20 which includes four registration stops 21, 22, 23 and 24 on the downstream end thereof and two non-driven urge rollers 25 and 26 on urge roller arms 25A–B and 26A–B, respectively, on the upstream end of unit 20. Holder 19 is attached, for example, to a document inserting station or a document queuing station (neither of which is shown) of a document processing system. Non drive urge rollers 25 and 26 are spaced at lateral positions between the lateral positions of registration stops 21 and 22 on the one hand, and the lateral positions of registration stops 23 and 24 on the other hand, respectively (see FIG. 2). Unit 20 pivots within holder 19 around pivot axis 31. A rotary solenoid 27 is linked to a pivoting arm 14 by a pin 28 which rides in a slot 15 of pivoting arm 14. Pin 28 moves along a circular path on each actuation of solenoid 27 and reciprocates in slot 15, thereby rocking pivot arm 14. As pivot arm 14 rocks, document registration unit 20 pivots around pivot axis 31.

Registration stops 21–24 are used to stop and align document 12 at document registration position 16, and then to release it for further processing. Document 12 is stopped and aligned at this position so that it can subsequently be processed with minimal skew relative to path 13, or if desired, some other document raceway as discussed above. For example, if document 12 is an envelope into which enclosures will be inserted, then registration stops 21–24 ensure that the envelope will be aligned relative to insertion of the enclosures. This insertion process can take place at document registration position 16 (where the envelope will be held open by an envelope opening claw) or, if desired, at a subsequent location along path 13. Similarly, if document 12 is an enclosure which will be subsequently inserted into an envelope, then registration stops 21–24 will ensure that the enclosure will be aligned relative to the envelope.

In order to stop document 12 at document registration position 16, document registration unit 20 is normally urged clockwise to position A (FIG. 3) when solenoid 27 is not energized. In position A, registration stops 21–24 extend into document path 13 and preferably project below the plane of conveyor system 11, so as to block document 12 from being transported further downstream by conveyor system 11. In the preferred embodiment, conveyor system 11 includes two conveyor belts 11A and 11B (see FIG. 4) which move in synchronization. Laterally spaced on each side of conveyor belts 11A and 11B are registration stops 21, 22 and 23, 24 respectively. The projection of stops 21–24 below the plane of conveyor system 11 assures that document 12 cannot slip past stops 21–24. Registration stops 21–24 are laterally-spaced along document registration unit 20 so that when document 12 is stopped at document registration position 16, the downstream edge 12*b* (see FIGS. 3 and 4) of document 12 is aligned with respect to document path 13, or if desired, any other path with which it is designed to align document 12. The continued travel of conveyor system 11 while document 12 is stopped assures that document 12 registers completely against stops 21–24. When it is time to release document 12, solenoid 27 is energized to pivot unit 20 to position B (see FIG. 3) where non drive urge rollers 25 and 26 urge document 12 against conveyor system 11, thus increasing the frictional force between document 12 and conveyor system 11. The increased frictional force is supposed to stop any slippage between document 12 and conveyor system 11 and moves document 12 downstream for further processing since registration stops 21–24 have pivoted out of the path of document 12.

As document 12 moves in the downstream direction, it encounters exit pinch rollers 32 and 33 which are mounted on independent sets of support arms 34A–34B, 35A–35B, corresponding to exit pinch rollers 32 and 33, respectively and which pivot about pivoting axis 31. Arms 34A, 34B, 35A, 35B and rollers 32 and 33 are respectively spring biased by separate compression springs (not shown) such that rollers 32 and 33 are urged against conveyor system 11. When a document 12 is released by moving registration stops 21–24 to position B, the released document 12 is caught in the nip between conveyor belts 11A and 11B and their respective pinch rollers 32, 33 so that the released document 12 is urged against conveyor system 11 by rollers 32, 33 and driven out of document registration apparatus 10. Moreover, when registration stops 21–24 are moved back to position A, the next document 12 is held in place. The mounting of rollers 32 and 33 on separate support arms 34A–34B, and 35A–35B results in minimal "shingling" of documents when a stack of documents exit the document registration apparatus 10. This is because rollers 32 and 33 and arms 34A–34B and 35A–35B can move away from conveyor system 11 as required by the thickness of document 12 to allow document 12 to pass without lifting the remainder of unit 20.

While the above-discussed design is very effective for many processing applications, it was discovered by the Applicants that when the document registration apparatus 10 was used at an inserting station, a number of potential problems existed. That is, document registration apparatus 10 can be used to receive and register envelopes for subsequent insertion of materials into those envelopes. In operation, an envelope 12 leaves a conventional flapper station where the envelope flap 12A is opened and the entire envelope 12 is transported by conveyor system 11 from the flapper station into the document registration apparatus 10 to await receipt of envelope 12 with registration stops 21–24 in the down position A. When the conveyor system 11 has driven envelope 12 up to stops 21–24, a conventional detector detects the correct positioning of envelope 12 and triggers a conventional envelope claw mechanism to operate to open the throat of the envelope to permit insertion of inserts into envelope 12. In the above-described structure the registration stops 21–24 and the non-driven urge rollers 25–26 are each mounted on a single structure 20B which pivots above axis 31. Thus, when the stops 21–24 are in the position A of FIG. 3, the non-driven urge rollers 25 and 26 are disposed away from the conveyor 11 and the envelope 12. Accordingly, the envelope 12 is only driven to the stops 21–24 by the forces developed from the weight of the envelope pressing against conveyor 11. However, slippage occurs between the conveyor belts 11A, 11B and the bottom of envelope 12 such that the conveyor belts 11A, 11B fail to deliver the envelope 12 to the stops 21–24. When this occurs, the system is set up, after a predetermined period of time has elapsed, to attempt to eject any envelopes in the document registration apparatus 10 or simply to indicate that a jam has occurred. Moreover, if slippage occurs between envelope 12 and one of the belts 11A and 11B, it is possible that the detector would still identify the envelope as being properly registered against the stops when in fact the envelope was delivered to stops 21–24 in a skewed position. If this situation occurred, the envelope claws would be activated but would be unable to properly open the throat of the envelope such that when the inserts were presented for insertion a jam could occur.

Previous attempts to correct the above-discussed problems included adding additional urge springs at the flapper station. The urge springs placed a biasing force on flap 12A of the envelope as it was carried away from the flapper station by the conveyor means 11. It was believed that the added force would help drive the envelope 12 completely to the registration stops 21–24. However, this solution proved unsatisfactory because the urge springs force, depending on the length of the flaps, tended to overdrive the flap 12*a* resulting in a partial closure of the flap 12*a* which would interfere with the subsequent inserting process and cause a jam in the document registration apparatus 10.

In addition to the above problem, it was also observed in the prior art structure that even if the envelope 12 was properly registered against the registration stops 21–24 such that the inserts were effectively inserted into envelope 12, the stuffed envelope 12 was not always effectively driven out of the document registration apparatus 10 subsequent to the moving of the registration stops 21–24 from the position A to position B. That is, if the frictional retarding forces acting on the stuffed envelopes was too great, the conveyor 11 together with the force exerted by the rollers 25, 26 would not always be capable of driving the envelope 12 out of the document registration apparatus 10. If this situation occurred, when the next envelope 12 was presented to receive its inserts, a jam would occur.

SUMMARY OF THE INVENTION

It is an object of the instant invention to provide a document registration apparatus which assuredly drives a document to the registration stops without damaging the document.

The above object is met by a document registration apparatus for use with a conveying device for transporting a document along a path from an upstream direction to a downstream direction through a document registration position, the document registration apparatus including an urge roller positioned adjacent to the path, the urge roller being moveable between a first urge roller position contacting the document and a second urge roller position out of contact with the document; apparatus for biasing the urge roller toward the conveying device; and a registration stop positioned adjacent to the urge roller and the path, the registration stop being moveable between a first registration stop position where the registration stop blocks transport of the document along the path and a second registration stop position away from the path where the registration stop does not block transport of the document along the path; wherein at times when the urge roller is in the first urge roller position and the registration stop is in the first registration stop position the biasing apparatus biases the urge roller against the document by a first force thereby urging the document against the conveying device due to the first force so that the document is moved to, aligned against, and stopped by the registration stop at the document registration position.

It is a further object of the invention to provide a document registration apparatus which assuredly drives a document out of a document registration apparatus subsequent to its registration in the document registration apparatus.

This object is met by providing in addition to the above structure a spring connected to the registration stop, and wherein at times when the urge roller is in the first urge roller position and the registration stop is in the second registration stop position the spring contacts and biases the urge roller against the document by a second force such that the document is urged against the conveying device by the first and second forces so that the document is moved from the document registration position in the downstream direction from the registration stop.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENT

Figure 1:
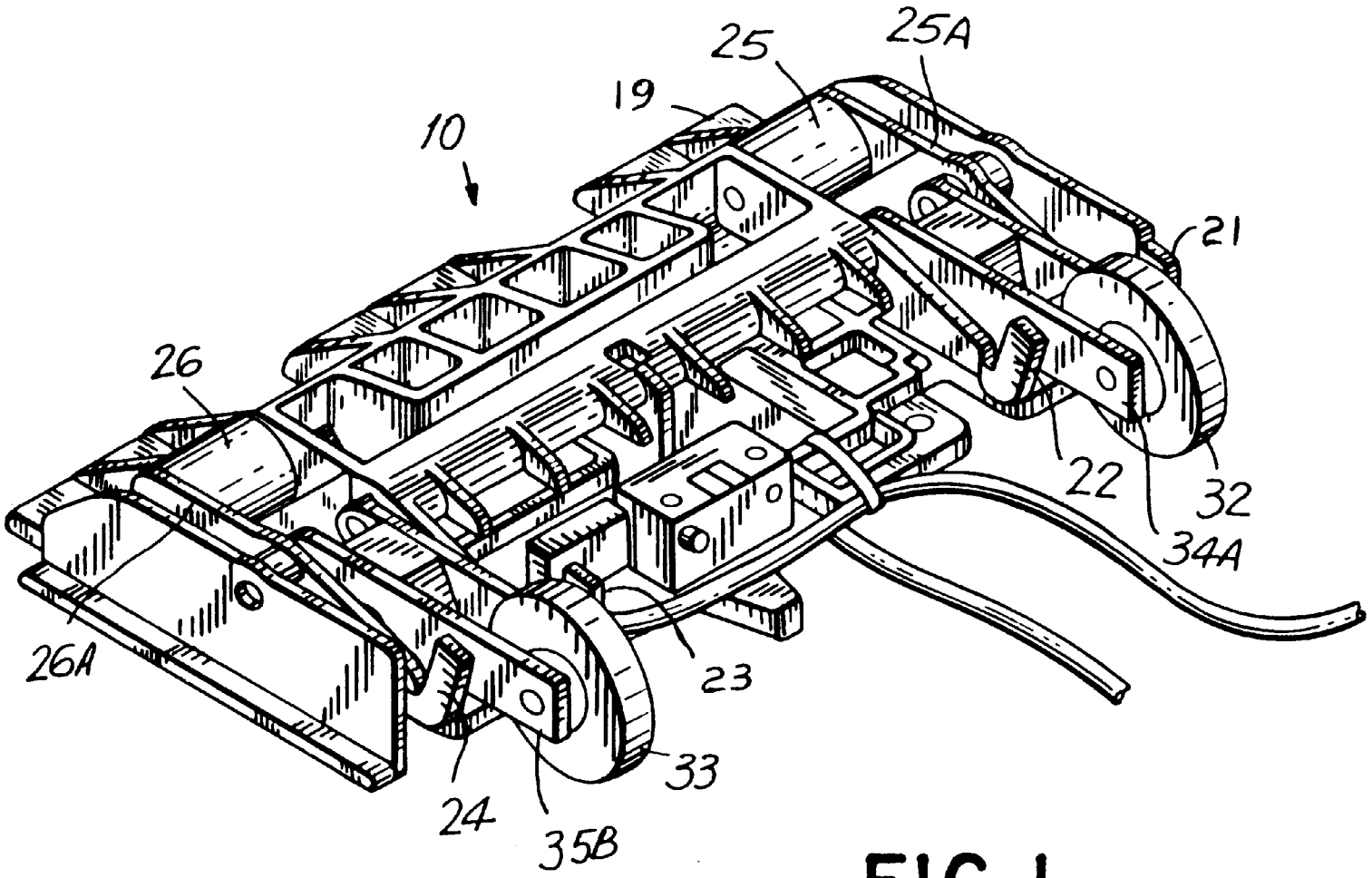
FIG. 1 (PRIOR ART)
FIG. 1 is a bottom perspective view of a prior art document registration apparatus.
Figure 2:
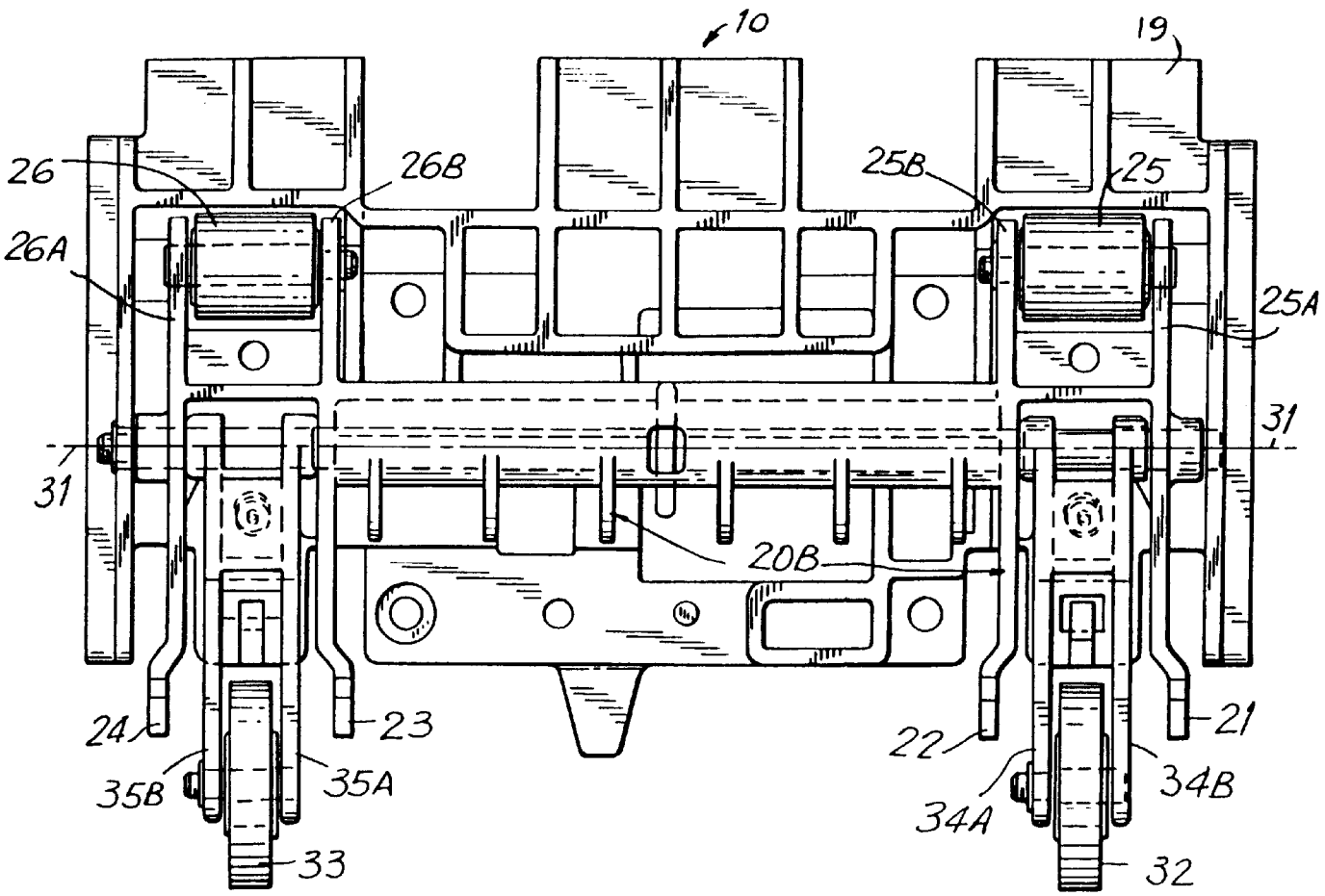
FIG. 2 (PRIOR ART)
FIG. 2 is a plan view of the apparatus of FIG. 1.
Figure 3:
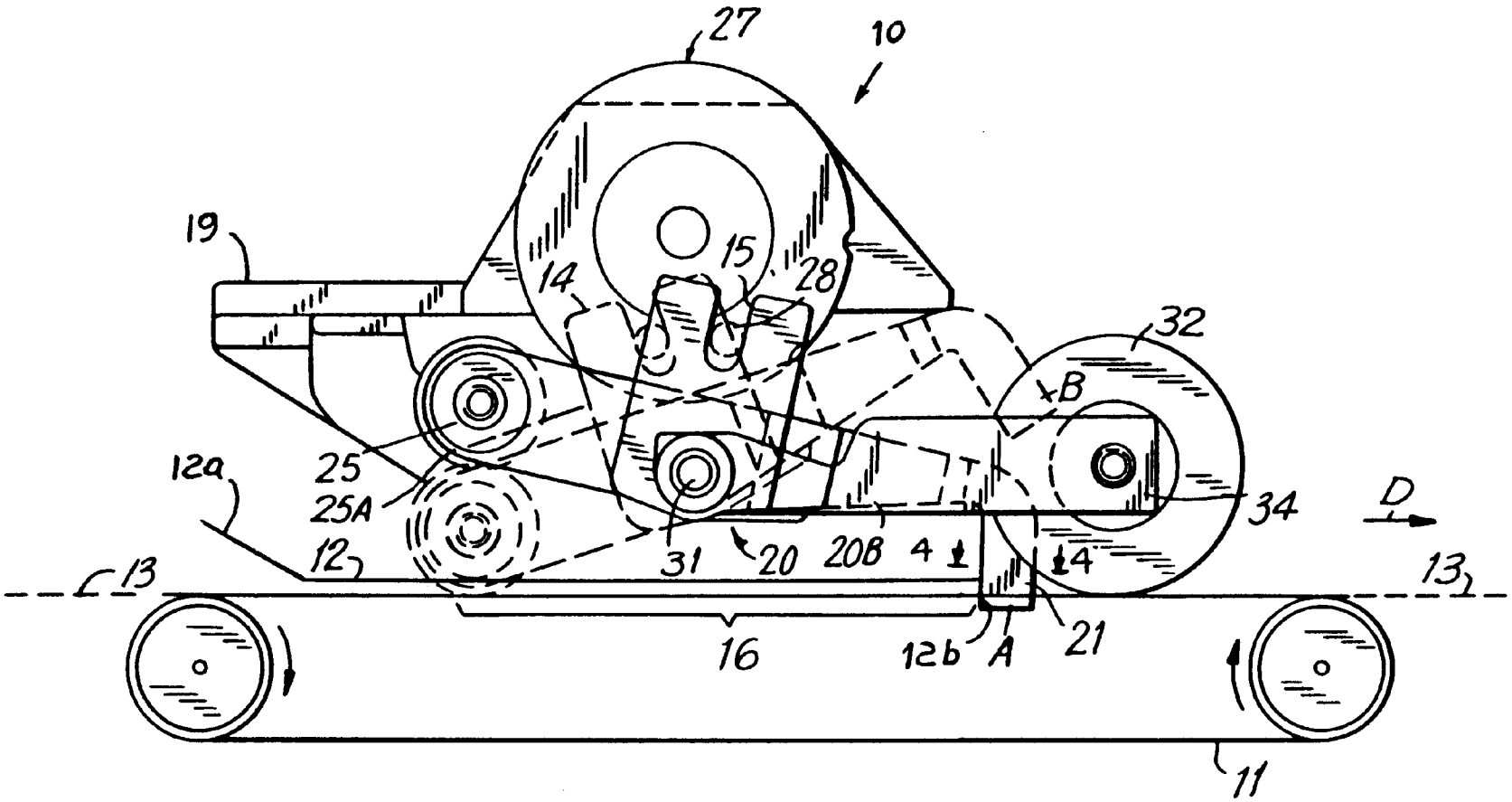
FIG. 3 (PRIOR ART)
FIG. 3 is a partly fragmented side view of the apparatus of FIG. 1 together with a conveyor system.
Figure 4:
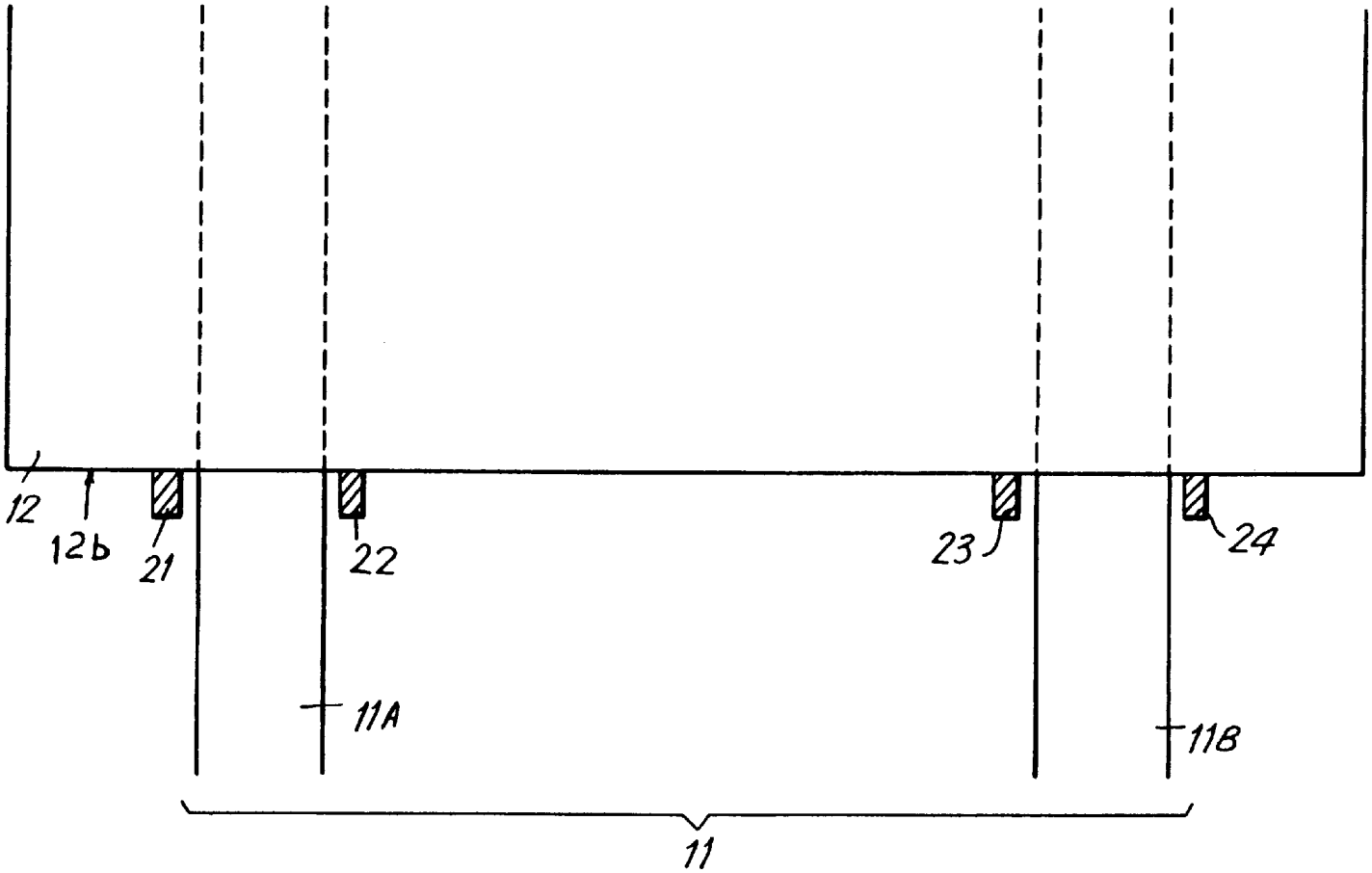
FIG. 4 (PRIOR ART)
FIG. 4 is a plan schematic view showing the relationship of the registration stops, envelope, and conveyor belts of FIG. 3.

The inventive document registration apparatus 51 will be described with reference to FIGS. 5–10. Document registration apparatus 51 includes a main frame 53 having an urge roller unit 55 and a registration stop unit 57 which are each mounted to pivot within main frame 53. Urge roller unit 55 includes a shaft 59 which is mounted for rotation in a pair of flanges 61 (only one is shown) extending from opposite sides of main frame 53. A pair of urge roller devices 63 are each mounted via a housing 65 for pivotal movement around shaft 59 which passes through cylindrical portion 66 of housing 65. Housing 65 further includes opposing flanges 67 between which a roller 69 is rotatably mounted. An urge spring 73 is disposed around shaft 59 to one side of cylindrical portion 66. Urge spring 73 is retained in place by a snap ring 75 which itself is mounted, for example, in a corresponding slot 77 in shaft 59. Furthermore, urge spring 73 has a first free end 79 disposed in a slot 81 of housing 65 and a second free end 83 which butts against the underside of main frame 53 such that first free end 79 bears against housing 65 and biases housing 65 together with roller 69 toward a conveyor system shown schematically at 85 (same as conveyor system 11 of the prior art) with a force of approximately 0.1 pounds at the nip between roller 69 and conveyor 85. Urge roller unit 55 further includes a lever 87 fixedly mounted to shaft 59 via pin 85 so that arm 87 rotates with shaft 59 as discussed in more detail below. Lastly, urge roller unit 55 includes a pair of additional pins 91 each of which are fixedly disposed within shaft 59 such that opposite ends of pins 91 extend out of shaft 59 for purposes to be described hereinafter below.

A first solenoid 93 is fixedly mounted to a bracket 95 which itself is fixedly mounted to main frame 53. Solenoid 93 has a housing 97 which is fixedly mounted to the bracket 95 and a disk portion 98 fixedly mounted to a shaft 99 to rotate therewith. A return spring of solenoid 93 is shown at 101 and a pin 103 is fixedly mounted to disk portion 98 and extends therefrom and rotates therewith.

Registration stop unit 57 includes a shaft 105 which is fixedly mounted at opposite end walls 106 (only one shown) of main frame 53. Mounted for rotation about shaft 105 is registration stop structure 107 which includes registration stops 107A, 107B, 107C, and 107D. Registration stop structure 107 also includes a slotted arm 107E extending therefrom. Additionally, a pair of leaf springs 109 are fixedly mounted in a conventional manner to registration stop structure 107.

Registration stop unit 57 further includes pinch roller structures 111 which operate in the identical manner as the pinch rollers 32 and 33 and support arms 34 and 35 which were discussed in connection with the prior art documents. That is, the pinch roller structures 32, 33 are biased by respective springs 113 toward conveyor 85 and are mounted for independent rotation about shaft 105. The only structural difference between the pinch roller structure 111 and that of the prior art is that leaf springs 115 are shown as being connected about a stud portion 117 of pinch roller support structure 111 to provide a light biasing force to document 12 as it is conveyed to stops 107A–D and is subsequently conveyed out of document registration apparatus 51. Thus, from the above description it is apparent to one possessing ordinary skill in the art that the pivotal movement of structure 107 and structure 111 around fixed shaft 105 are independent from each other.

A second solenoid 117 identical in structure to solenoid 93 is also shown as being fixedly mounted to bracket 95. The housing 119, plate 121, spring 123, shaft 125 and pin 127, are all identical in structure and function to the corresponding parts described for solenoid 93 such that a description of these parts in connection with solenoid 117 is not warranted.

Figure 5:
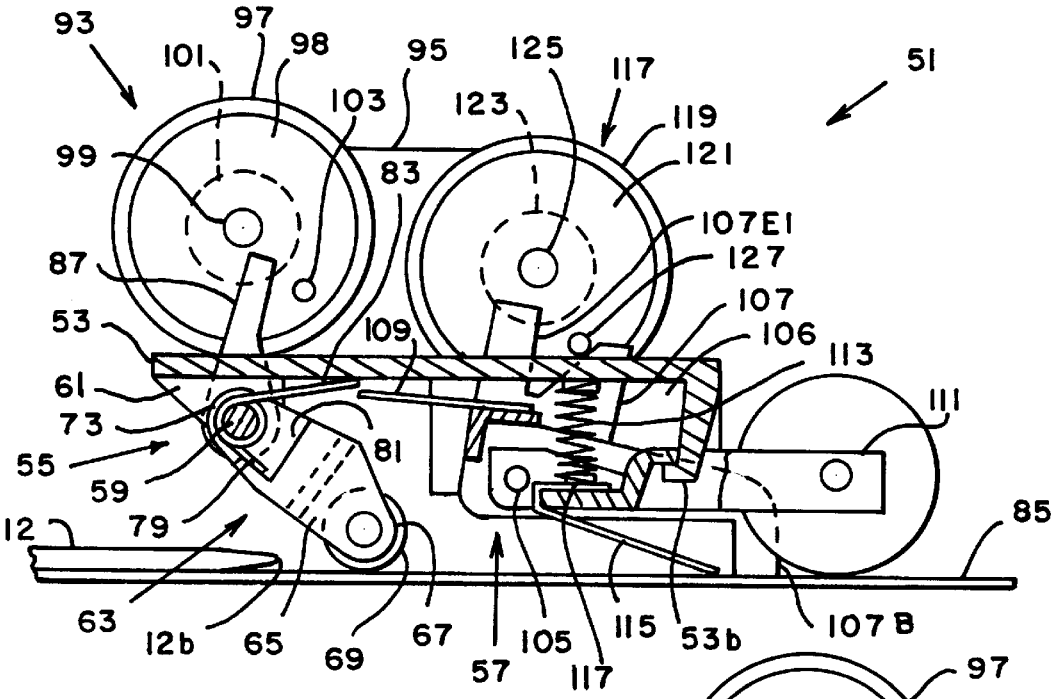
FIG. 5 is a partly fragmented side view of the inventive document registration apparatus in a position waiting to receive a document.
Figure 6:
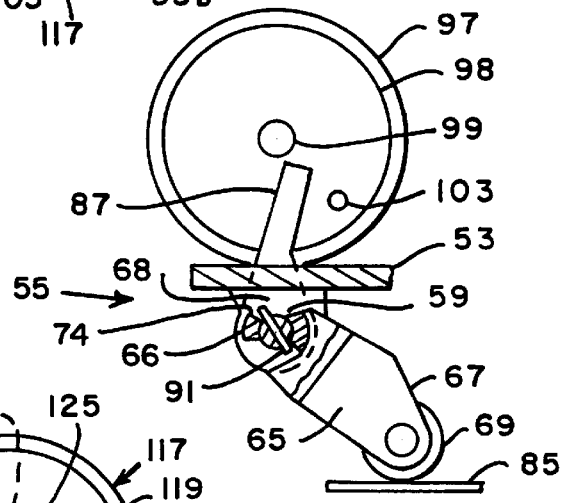
FIG. 6 is a cut away view of a portion of FIG. 5 showing the shaft and pin structure.

A description of the operation of the inventive document registration apparatus 51 will now be described in connection with the sequence shown via FIGS. 5–9. FIG. 5 shows the document registration apparatus 51 in its normal position waiting for delivery of envelope 12 by conveyor 85. In this position, solenoids 93 and 117 are both not energized such that the pins 103 and 127 are maintained in the positions shown by the force of respective springs 101 and 123. In this position, solenoid 93 exerts no force on arm 87 and housing 65 is biased toward conveyor 85 due to the action of spring 73. Pin 91, as shown in FIG. 6, extends beyond the outer surface of shaft 59. However, a clearance 74 is left between pin 91 and a cut away section 68 of housing 65. Clearance 74 ensures that both rollers 69 contact conveyor 85 to accommodate any unparallelism between document registration apparatus 51 and a feed deck)not shown) along which document 12 is conveyed. Movement of pin 91 in the clockwise direction beyond that shown in FIG. 6 is not possible because arm 87 which extends through a cut out (not shown and which permits movement of arm 87) in mainframe 53 abuts against mainframe 53 in the clockwise direction as shown in the position of FIG. 5. However, in the position of FIG. 5, housing 65 is free to rotate about shaft 59 in the counterclockwise direction to accommodate different thickness envelopes 12 while applying a downward driving force to envelope 12 due to spring 73.

FIG. 5 also shows that structure 107 is biased in a downward position to extend below the upper surface of conveyor 85 due to the force of spring 123 acting through pin 127 on structure 107E. Moreover, pinch roller structure 111 is biased downwardly by spring 113 against a stop portion 53*b* of mainframe 53.

Figure 7:
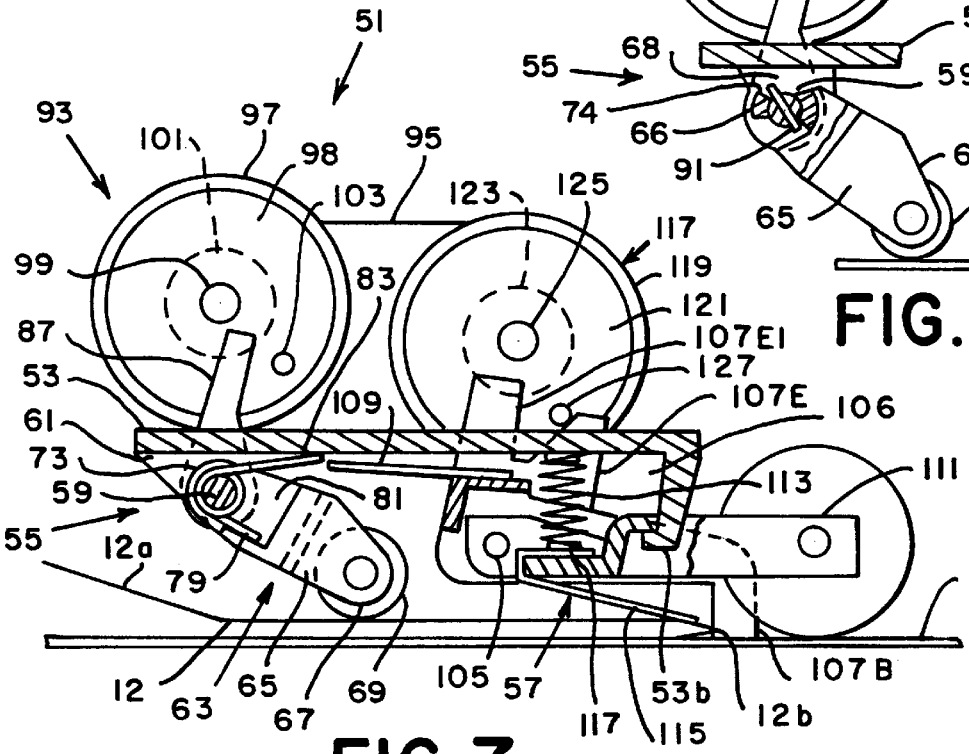
FIG. 7 is similar to FIG. 5 except that the apparatus is shown in a position where the document is being transported to the registration stops.

In FIG. 7, as the envelope 12 is delivered into the document registration apparatus 51, housing 65 is rotated upwardly about shaft 59 in the counterclockwise direction and applies a force onto envelope 12 due to spring 73 via roller 69. The force applied by spring 73 on envelope 12 ensures a good frictional engagement between conveyor 85 and envelope 12 such that envelope 12 is assuredly driven against stops 107A–107D. However, in order to ensure that the driving force provided by spring 73 is not large enough to either crumple envelope 12 or drive it up the stops 107A–107D, the force of spring 73 should not exceed approximately 0.1 pounds.

Figure 8:
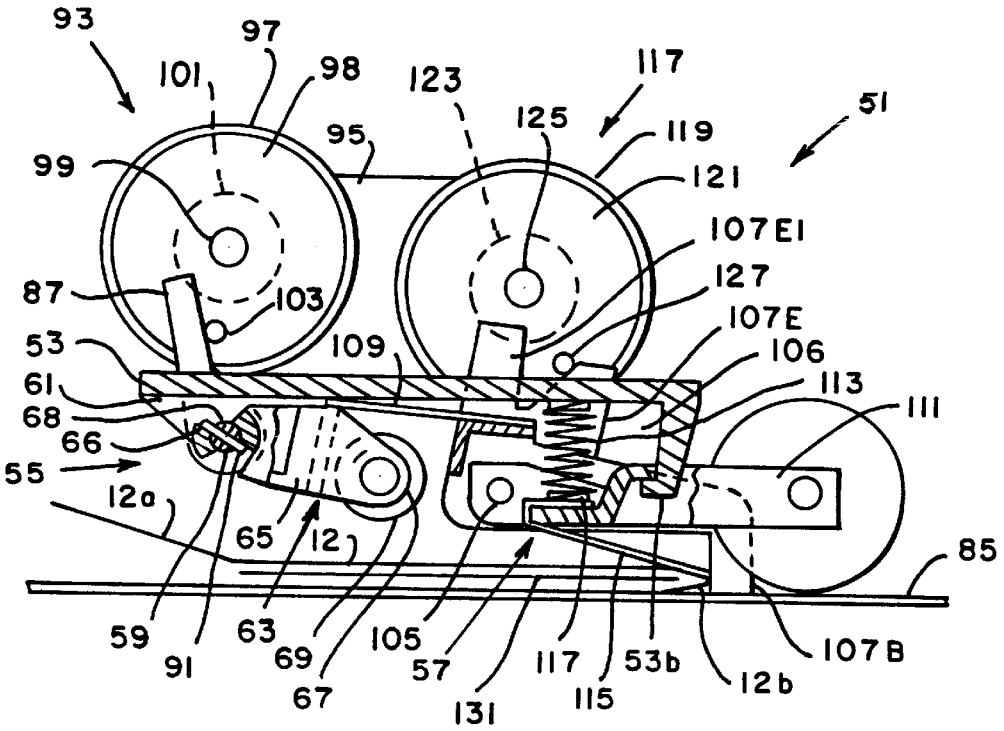
FIG. 8 is a view similar to FIG. 5 except that the apparatus is in the position where the document receives an insert.

FIG. 8 shows the position of document registration apparatus 51 during insertion of an insert 131 into envelope 12. In this position, solenoid 97 has been energized to rotate plate 98 and pin 103 to the position shown in FIG. 8. As pin 103 is rotated in the clockwise direction it interferes with arm 87 thereby forcing arm 87 and shaft 59 to rotate in the counterclockwise direction. As pin 91 rotates in the counterclockwise direction with shaft 59, it interferes with cut away section 68 of housing 65, which in turn causes housing 65 to rotate in the counterclockwise direction away from and out of contact with the top surface of envelope 12. This position of housing 65 is desired once envelope 12 has been driven against stops 107A–107D in order to permit insertion of the insert 131 into envelope 12 without interference from roller 69.

Figure 9:
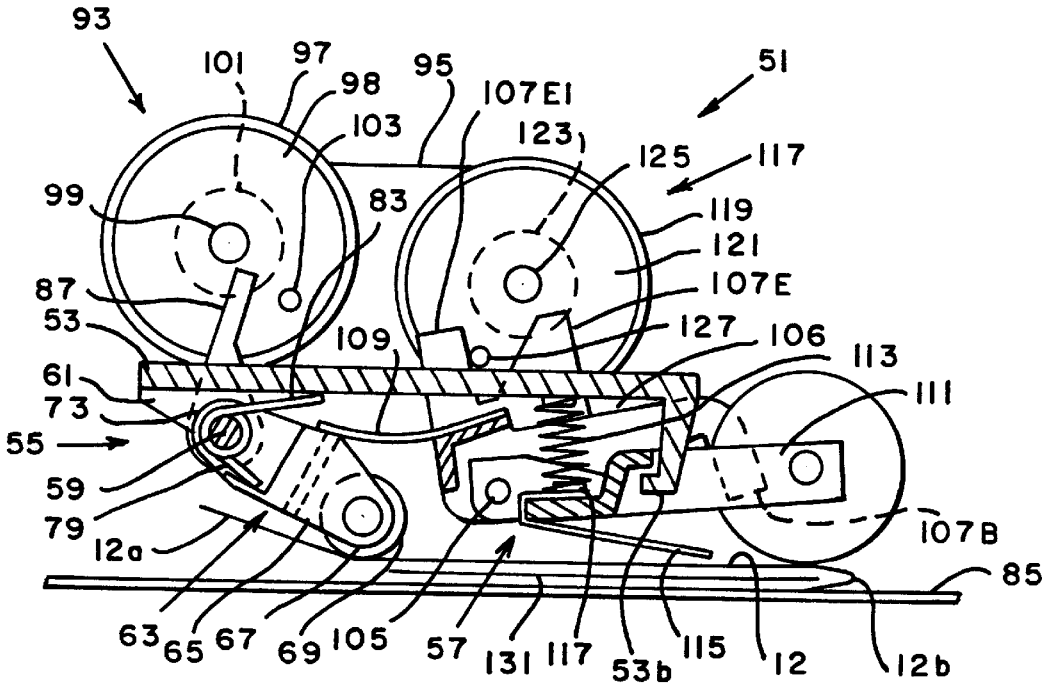
FIG. 9 is a view similar to FIG. 5 except that the apparatus is in the position where the document with insert is being ejected.
Figure 10:
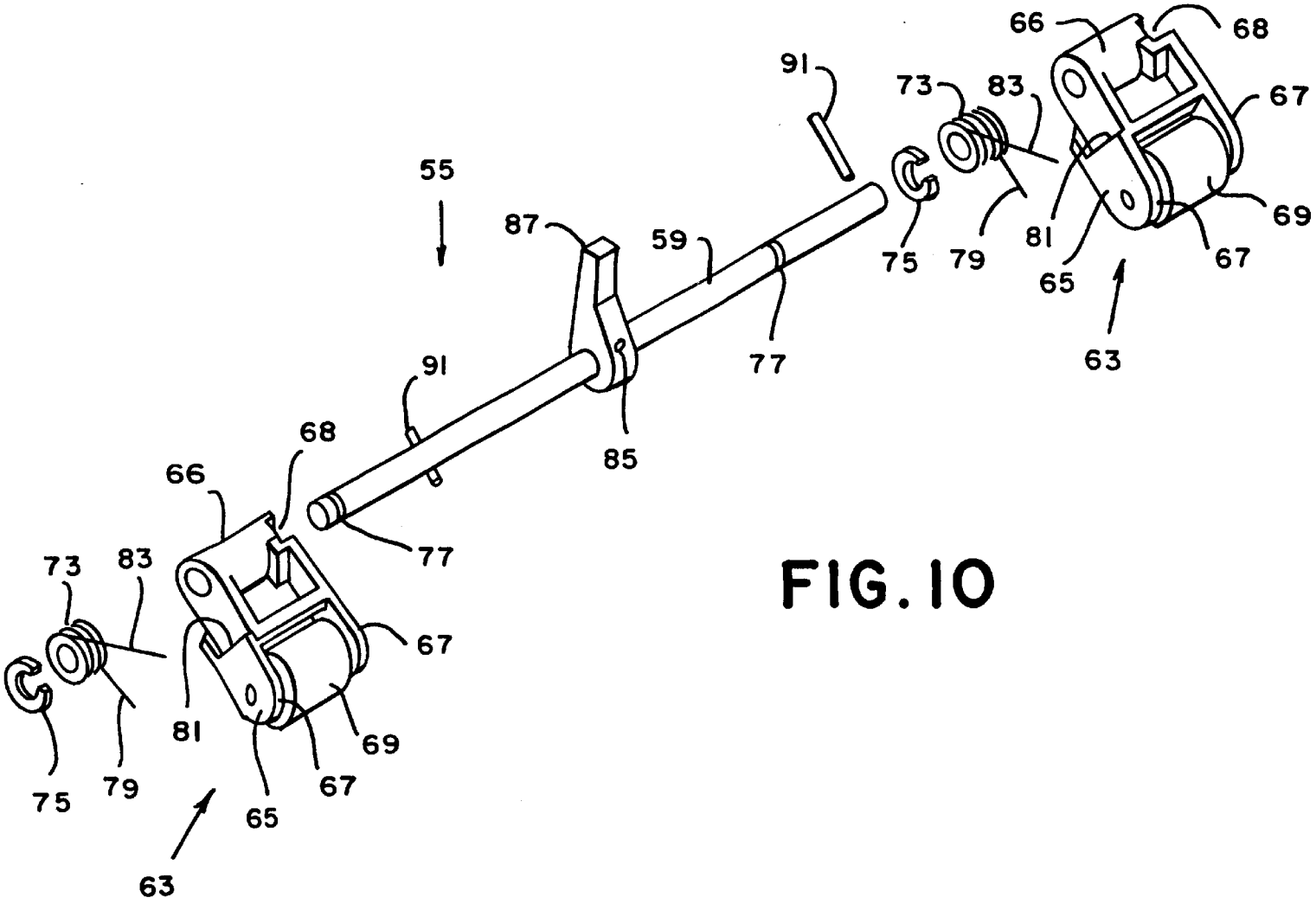
FIG. 10 is an exploded view of the urge roller unit.
Figure 11:
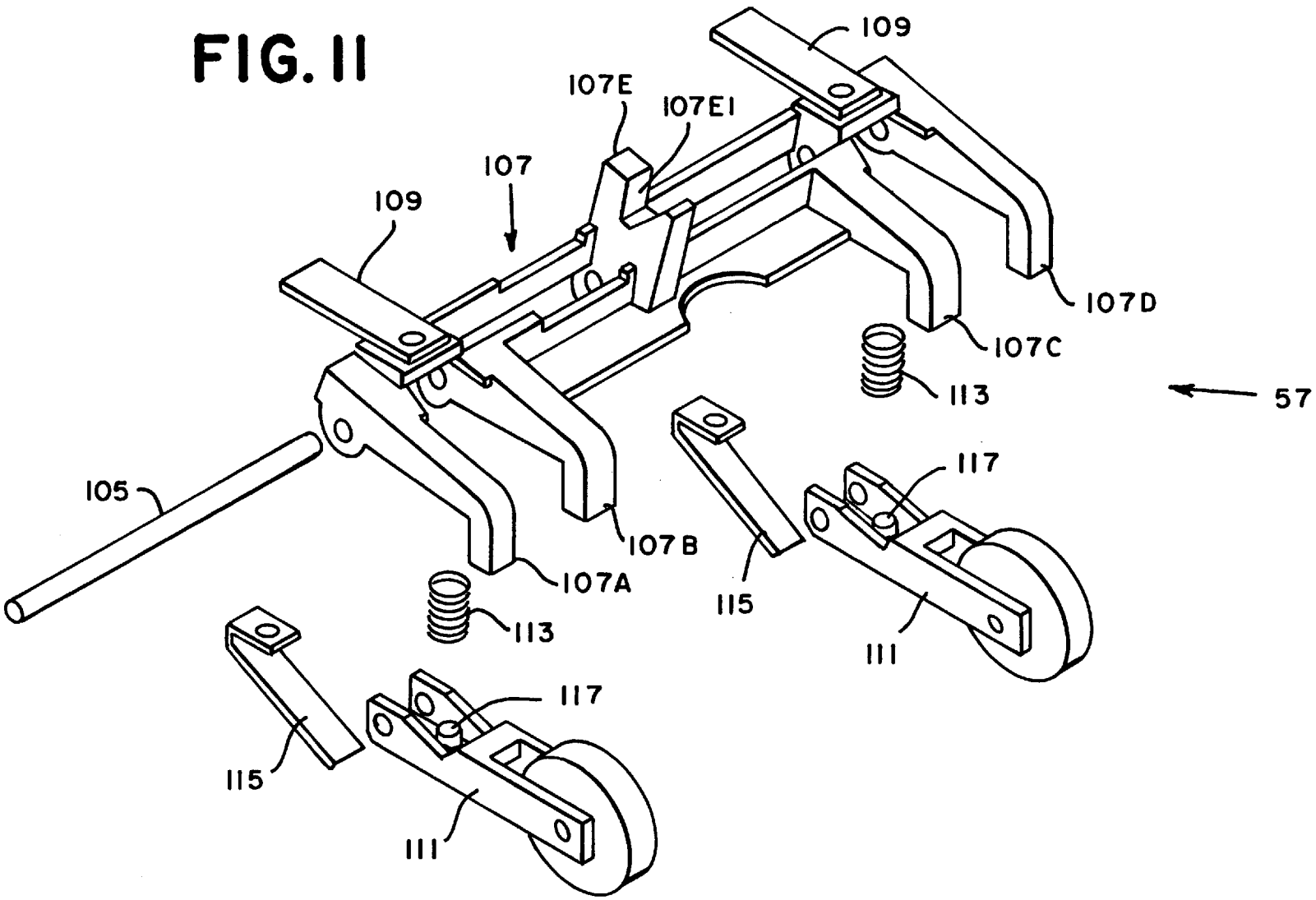
FIG. 11 is an exploded view of the registration stop unit.

FIG. 9 shows the position of the document registration apparatus 51 subsequent to insertion of insert 131 into the envelope 12. At this point in time envelope 12 with insert 131 is conveyed to the next processing station. Accordingly, solenoid 93 is de-energized such that pin 103 returns back to the same position as in FIG. 5 due to the force of return spring 101. Spring 83 then returns housing 65 and roller 69 to a position where roller 69 applies a downward driving force against envelope 12. Moreover, solenoid 117 is energized to rotate pin 127 in a clockwise direction until pin 127 interferes with an end portion 107E1 of arm 107E to force structure 107 to rotate in a counterclockwise direction around shaft 105 thereby raising stops 107A–107D away from the leading edge 12*b* of envelope 12. Moreover, as structure 107 rotates about shaft 105, leaf springs 109 each contact a corresponding housing 65 and together apply an additional total maximum downward driving force of approximately 12 ounces which acts on housing 65 and envelope 12 via roller 69. The additional driving force of leaf springs 109 together with the driving force of urge springs 83 ensure that the envelope 12 with insert 131 can be moved out of document registration apparatus 51. Accordingly, leaf springs 109 supply an additional booster driving force in addition to that supplied by urge springs 83 during the ejection mode of operation. Once envelope 12 has been cleared from document registration apparatus 51, solenoid 117 is de-energized to rotate back to the position of FIG. 5 where the document registration apparatus 51 awaits receipt of the next envelope 12.

One possessing ordinary skill in the art will understand from the description set forth above, that the inventive document registration apparatus 51 separates the envelope drive and stop functions, which were accomplished by the prior art single pivoting structure, into two separate functional modules which are each actuated by their own solenoid. This permits use of urge roller unit 55 to engage the envelope 12 in order to assuredly drive the envelope 12 against the registration stops 107A–107D. The force of urge springs 73 however is limited to ensure that the envelope is not caused to buckle when it is forced against the registration stops or to creep up the registration stops 107A–D themselves. In addition, during the ejection mode of operation, the urge roller unit 55 is used to eject the envelope 12 from document registration apparatus 51. However, additional ejection driving force is provided by leaf springs 109. In the prior art structure, the force of the urge rollers 25, 26 against the envelope 12 was solely provided by solenoid 27. Accordingly, it is clear that the inventive structure more assuredly, as compared to the prior art structure, 1) drives the envelope 12 up against the registration stops and 2) ejects the envelope 12 with the insert 131 therein from the document registration apparatus.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims.

What is claimed is:

1. A document registration apparatus for use with a conveying means for transporting a document along a path from an upstream position to a downstream position through a document registration position, the document registration apparatus comprising:

an urge roller positioned adjacent to the path, the urge roller being moveable between a first urge roller position contacting the document and a second urge roller position out of contact with the document;

means for biasing the urge roller toward the conveying means;

a registration stop positioned adjacent to the urge roller and the path, the registration stop being moveable between a first registration stop position where the registration stop blocks transport of the document along the path and a second registration stop position away from the path where the registration stop does not block transport of the document along the path; and a spring connected to the registration stop;

wherein at times when the urge roller is in the first urge roller position and the registration stop is in the first registration stop position the biasing means biases the urge roller against the document by a first force thereby urging the document against the conveying means due to the first force so that the document is moved to, aligned against, and stopped by the registration stop at the document registration position;

wherein at times when the urge roller is in the first urge roller position and the registration stop is in the second registration stop position the spring contacts and biases the urge roller against the document by a second force such that the document is urged against the conveying means by the first and second forces so that the document is moved from the document registration position in a downstream direction from the registration stop.

2. A document registration apparatus as recited in claim 1, further comprising means for moving the urge roller between the first and second urge roller positions and means for moving the registration stop between the first and second registration stop positions, the urge roller moving means and the registration stop moving means being independently operable from each other.

3. A document registration apparatus as recited in claim 1, wherein the first force is approximately 0.1 pounds.

4. A document registration apparatus as recited in claim 1, wherein the second force is approximately 0.38 pounds.

5. A document registration apparatus as recited in claim 1, further comprising means for moving the urge roller, and a main frame upon which the registration stop is movably mounted, and wherein the urge roller is part of an urge roller unit, the urge roller unit including 1) a shaft mounted to rotate in the main frame, 2) an urge roller housing within which the urge roller is mounted to rotate, the urge roller housing mounted to rotate around the shaft, 3) a pin fixedly mounted in and extending from the shaft, 4) a lever fixedly mounted to the shaft to rotate therewith, and wherein the urge roller moving means is moveable between an operative position and an inoperative position such that when the urge roller moving means moves from the inoperative position to the operative position it contacts the lever and forces the lever, shaft, and pin to rotate whereby the pin contacts the urge roller housing causing the urge roller housing to move the urge roller to the second urge roller position and when the urge roller moving means moves from the operative position to the inoperative position the biasing means forces the urge roller to move into the first urge roller position.

* * * * *